US006190727B1

(12) United States Patent
Thaggard

(10) Patent No.: US 6,190,727 B1
(45) Date of Patent: Feb. 20, 2001

(54) LIQUID COATING SPRAY APPLICATOR AND METHOD PROVIDING AUTOMATIC SPREAD RATE CONTROL

(75) Inventor: Charles E. Thaggard, Monroeville, AL (US)

(73) Assignee: Georgia-Pacific Corporation, Atlanta, GA (US)

( * ) Notice: Under 35 U.S.C. 154(b), the term of this patent shall be extended for 0 days.

(21) Appl. No.: 09/182,632

(22) Filed: Oct. 30, 1998

(51) Int. Cl.[7] ..... B05D 1/02; B05C 11/02

(52) U.S. Cl. ..... 427/9; 427/8; 427/421; 427/424; 118/313; 118/314; 118/323; 118/674; 118/680

(58) Field of Search ..... 118/305, 313, 118/314, 323, 324, 668, 672, 674, 679, 680; 427/8, 421, 424, 9

(56) References Cited

U.S. PATENT DOCUMENTS 4,367,244 * 1/1983 Holmes ..... 427/8
5,922,132 * 7/1999 Martel ..... 118/703
5,938,848 * 8/1999 Hogan et al. ..... 118/682
5,968,271 * 10/1999 Maxwell et al. ..... 118/671
6,037,009 * 3/2000 Clare et al. ..... 427/421

* cited by examiner

*Primary Examiner*—Shrive Beck
*Assistant Examiner*—Jennifer Calcagni
(74) *Attorney, Agent, or Firm*—Banner & Witcoff, Ltd.

(57) ABSTRACT

A spray application apparatus and method, well suited for use in a plywood production resin spray line, provides automatic control of the spread rate of resin applied to the veneer layers built-up to form plywood panels. In lieu of the conventional trial and error method of manually adjusting the height of a spray nozzle to adjust the spread rate, a controller, actuator, and various sensors are utilized in conjunction with a novel control algorithm to achieve continuous automatic spread rate control. The control effectively compensates for variations in process parameters (e.g., resin flow rate, conveyor line speed and veneer temperature) during a production run, whereby product quality is increased with reduced resin consumption. The controller is easily and effectively calibrated without the need to obtain accurate initial values of the variable process parameters.

26 Claims, 7 Drawing Sheets

LIQUID COATING SPRAY APPLICATOR AND METHOD PROVIDING AUTOMATIC SPREAD RATE CONTROL

BACKGROUND OF THE INVENTION

The present invention relates to the spray application of liquid coatings to articles in a production line process. In particular, the invention concerns spray line apparatus and methods used to apply resin in the commercial production of multi-layer laminate products such as plywood.

Most plywood plants use what is known in the industry as a "spray line" to apply resin to and assemble layers of veneer to make plywood. A typical spray line is schematically represented in Prior Art FIG. 1. The spray line includes a continuous conveyor 1 with a number of "drop stations" 3 arranged therealong. Drop stations 3 are where successive layers of wood veneer 5 are placed on top of each other to build-up the layers of the panels. For simplicity, only four drop stations are shown in FIG. 1. For the production of plywood, a spray line will commonly include a total of ten drop stations, corresponding to the ten layers of two five layer plywood panels to be produced. Initial positioning of the veneer layers at the drop stations is done automatically by a conventional conveyor apparatus (not shown). A closer alignment of the panels is performed manually by an attendant, as necessary. Eight of the drop stations are arranged adjacent to, and directly upstream of, a spray booth 7 where resin is applied to the top surface of the veneer layer just "dropped." Once the resin is applied, another layer of veneer is added at the next station. This process is repeated until a complete plywood panel has been assembled. At the fifth drop station, the last layer of a first panel assembly formed in the line is applied. The build-up of a second panel assembly, on top of the first, is started at the sixth drop station, which is located adjacent the fifth station (with no spray booth in between). The second panel assembly is completed at the tenth drop station. Next, a stacked load of thirty to forty of the resultant panel-forming assemblies is pre-pressed as a batch. This is carried out at ambient temperature and a pressure of about 150 psi, in a conventional pre-press apparatus (not shown), to make the individual panel assemblies rigid enough to be hand loaded into a standard hot press. In the hot press (not shown), panels are hot-pressed individually between plates heated to 280°–330° F., under a pressure of about 175 psi.

Each spray booth includes an open-bottom box-shaped enclosure (omitted for clarity) in line with the conveyor, which houses a spraying apparatus. The conveyor carrying the veneer mat moves continuously through the open-ended bottoms of the spray booths. In each booth, resin is pumped under pressure through a downwardly directed spray nozzle (also referred to as a "wand") 9. Nozzles 9 produce a generally flat spray pattern 10 having an inverted triangular shape viewed in the moving direction of the conveyor. The spray pattern envelopes the entire width of the veneer mats as they move through the booth. The edges of the spray pattern extend beyond the edges of the veneers, creating an overspray 11. This overspray drains through a trough 13 at the bottom of the booth and is recovered for reuse with a conventional recycle circuit comprising a resin tank 15, pump 17 and pressure header 19.

Typically, resin flow rates and pressures range from 2 to 3 gallons per minute and 100 to 200 psi respectively. The amount of resin applied to the veneer (this is measured as a "spread rate," i.e., weight of resin applied per unit area of veneer surface) is critical. Depending on various process parameters, e.g., the thickness and moisture content of the veneer layers, veneer temperatures and the ambient temperature, the ideal flow rate may vary from 30 to 60 lb/mft$^2$. Usually, a phenolic based resin with a resin solids content of around 30% is used.

The amount of resin applied to each layer of veneer at a given flow rate depends on the distance from the veneer surface to be coated to the spray nozzle, which is usually 30" to 60". The nozzle (which is movably mounted) is lowered closer to the veneer to increase the spread rate. It is raised to decrease the spread rate. The conventional technique for adjusting the spread rate is to manually raise or lower the nozzle on a trial and error basis until the desired spread rate is achieved. Spread rates are measured using a standard sized (e.g., 4"×47") metal test strip (nominal thickness of about 1/16") that is placed on the veneer and passed through the spray pattern. The amount of resin (by weight) on the test strip is determined as the difference in the weight of the test strip before and after spraying; the spread rate is determined from the resin weight and a chart which converts weights to per-unit densities, based upon the top surface area of the test strip. Once the desired spread rate has been achieved, the nozzle is fixed at a height above the conveyor corresponding to the desired spread rate.

A shortcoming of the above-described conventional process/apparatus is that it does not take into account variations in process parameters (e.g., resin flow rates and line speeds) that may cause the actual spread rate to deviate significantly from the desired spread rate during a production run. In order to avoid the possibility of a reduction in the spread rate resulting in improper lamination, the target spread rate is typically set higher than would otherwise be required. This results in higher resin consumption and costs than would be necessary if a desired spread rate could be more reliably maintained. In addition, excess resin application can lead to defective lamination of the veneer layers. For example, during the hot pressing operation, excessive moisture resulting from an excessive amount of applied resin may vaporize and build-up pressure within the panels until a "blow" occurs causing separation of the veneer layers.

A related problem is the effect of variations in the temperature of the veneer on the set-up or thickening of the applied resin prior to pressing. At the time of pressing, a degree of curing of the resin layer to a tacky state is desirable; however, a proper lamination will not be formed if the resin has cured excessively prior to the hot-pressing operation. Such curing and thickening of the resin occurs more rapidly if the temperature of the veneer is elevated. In this case, application of the resin at a higher spread rate can compensate for the increased curing rate and ensure an appropriate degree of tackiness of the resin at the time of hot pressing. In the conventional technique, no provision other than ad hoc and occasional adjustment for observed/sensed temperature variations is made to account for such in-process variations in the temperature of the veneer.

One known spray control system, offered by Drying Technology Co. of Salsbee, Tex., sought to maintain an optimum spread rate by automatically varying the height of the spray nozzle above the conveyor in relation to detected changes in (1) a pressure of the resin supply line at the spray nozzle; (2) conveyor speed; and (3) a detected temperature of the veneer. The present inventor is unaware of the particular control algorithm of this system. In any event, he found that this system did not satisfactorily achieve its objective of consistently maintaining an optimum spread rate.

SUMMARY OF THE INVENTION

In view of the foregoing, it is a principal object of the present invention to provide a liquid coating (e.g., resin) spray application system and process capable of consistently maintaining a target spread rate. By consistently maintaining a target spread rate, more consistent product quality is obtainable and spread rates can be reduced, leading to improved product quality and significant savings in resin costs.

It is a further object of the invention to provide a resin application system and process as aforesaid, and with a further provision for automatically adjusting the target spread rate in order to compensate for veneer temperature induced fluctuations in the pre-pressing curing rate of the resin.

These and other objects are achieved in accordance with the present invention by a spray coating apparatus providing automatic spread rate control. The apparatus includes a spray nozzle that produces a diverging spray pattern having a generally flat triangular shape, and a supply line connected to the spray nozzle for supplying a liquid coating material under pressure thereto. A conveyor includes a moving surface arranged to carry articles past the spray nozzle and through the diverging spray pattern such that a coating of the liquid coating material is applied to a surface of the articles. An actuator has a movable member connected to the spray nozzle for moving the spray nozzle toward and away from the moving surface of the conveyor. A control means is provided for computing a target position of the movable member as a function in which a distance D of the nozzle to the surface of the article to be coated varies in inverse proportional relationship to a target spread rate S'. The control means also controls the actuator to move the movable member to the computed target position, in order to maintain target spread rate S' on the surface.

In another aspect, the invention is embodied in a method of calibrating a spray coating apparatus as just described. In the method, the control means is caused to position the spray nozzle, with the actuator, in accordance with the function, including an initial arbitrarily assigned value of c and an arbitrary value of S'. A liquid coating material is supplied under pressure to the nozzle. A test piece of material is conveyed through the spray pattern on the conveyor. A determination is made from the test strip of an actual spread rate S". An error value E is calculated as the difference between the actual spread rate S" and the target spread rate S'. A corrected initial value of c is calculated according to the formula:

$$c_{corr.}=((S'+E)/S')\cdot c,$$

and $c_{corr.}$ is substituted for c in the function.

In yet another aspect, the invention is embodied in a method of controlling a spray coating apparatus as aforesaid. The method includes the steps of computing a target position of the movable member as a function in which a distance D of the nozzle from the surface of the article to be coated varies in inverse proportional relationship to a target spread rate S', and controlling the actuator to move the movable member to the computed target position in order to maintain target spread rate S' on the surface.

Still another aspect of the invention resides in a machine readable storage media storing a program which when executed enables a controller to control a spray coating apparatus as aforesaid, to maintain a target spread rate. The control provided by the stored program includes computing a target position of the movable member as a function in which a distance D of the nozzle to the surface to be coated varies in inverse proportional relationship to a target spread rate S', and controlling the actuator to move the movable member to the computed target position in order to maintain target spread rate S' on the surface.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
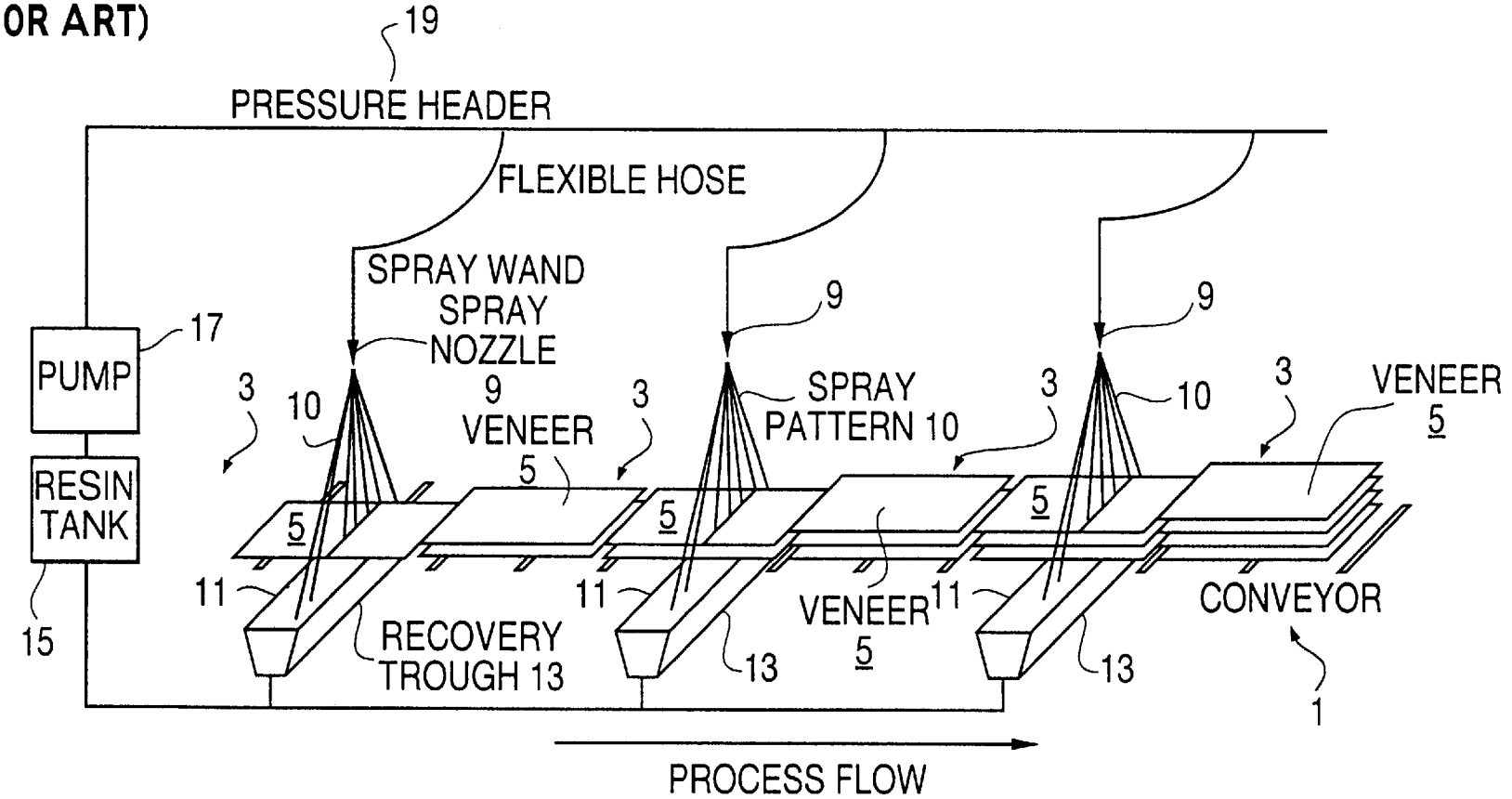
FIG. 1 (PRIOR ART)
FIG. 1 is a schematic view of a conventional spray line used for the production of plywood panels.
Figure 2:
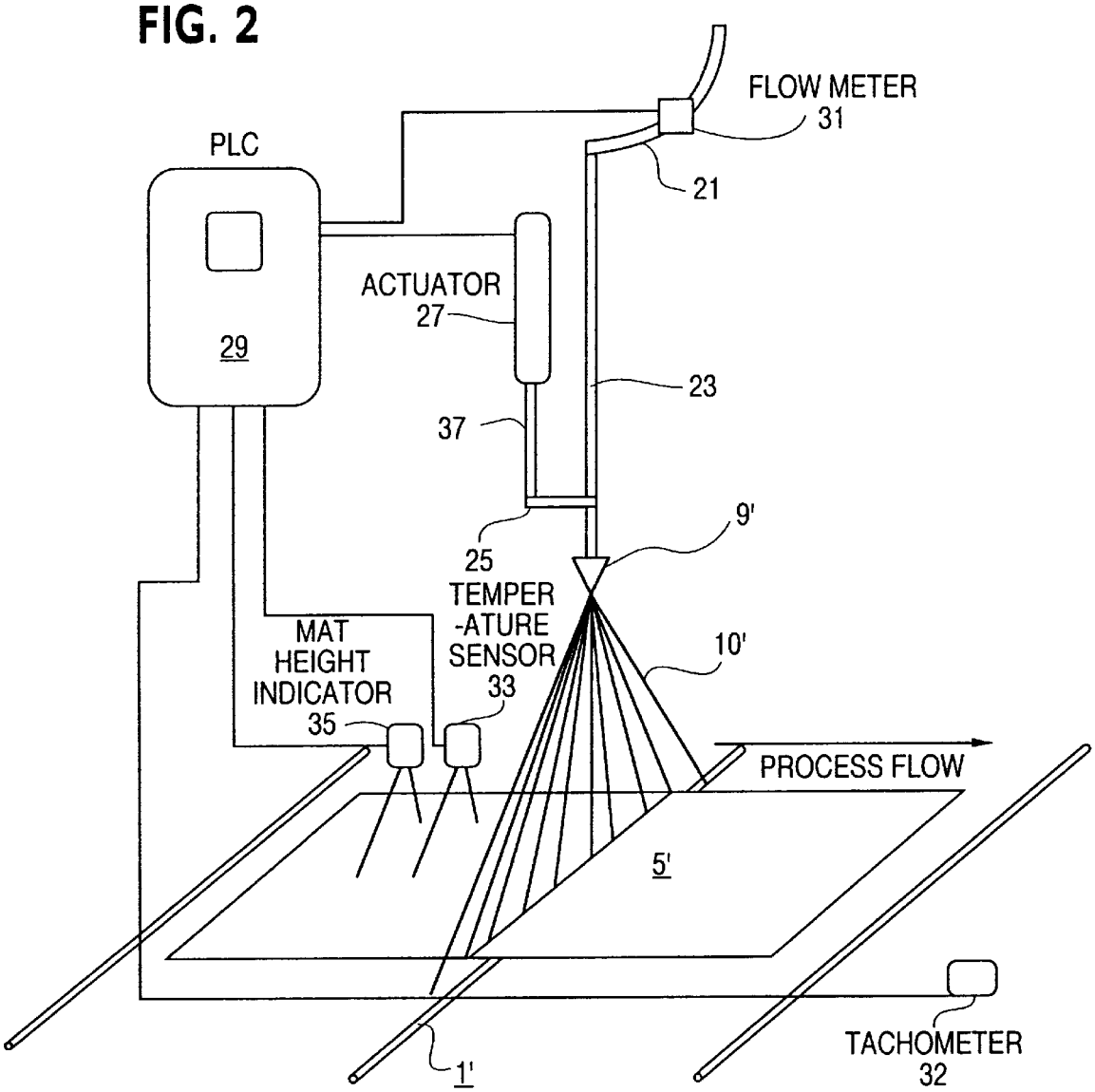
FIG. 2 is a schematic view of a resin spray application system providing automatic spread rate control in accordance with the present invention, representing a modification of the conventional spray system shown in FIG. 1.

Referring initially to FIG. 2, an automatic spread rate control system according to the present invention, well suited for incorporation into a conventional type spray line as shown in FIG. 1, is illustrated. The system includes a spray nozzle 9' which may be a conventional type (e.g., Spraying Systems Co. Nos. 2 or 4) that produces a diverging spray pattern 10' having a generally flat triangular shape. A supply line (e.g., flexible hose) 21 is connected to nozzle 9' through a rigid vertical pipe 23, whereby liquid coating material (resin in the exemplary embodiment) is supplied under pressure to the nozzle. Attached to rigid pipe 23 is an arm 25 of an actuator 27 serving to move spray nozzle 9' toward and away (downwardly and upwardly in the illustrated preferred embodiment) from the moving surface of a standard conveyor 1'. Conveyor 1' is arranged to carry articles (e.g., plywood veneers 5') past spray nozzle 9' and through diverging spray pattern 10' such that a coating of resin is applied to the generally planar top surface thereof.

Control of actuator 27 is preferably provided by a programmable logic controller (PLC) 29. PLC 29 receives signals from various sensors measuring key process parameters upon which control of the actuator (and hence nozzle) position will be carried out. The sensors used in the present invention may be off-the-shelf analog output types commonly used throughout many manufacturing processes. Digital output devices may also be used.

A flowmeter 31 is provided in resin supply line 21 for measuring a flow rate of the resin and generating a signal indicative thereof which is supplied to PLC 29. Flowmeter 31 is, in a preferred embodiment, a Krohne (Peabody, Mass.) ½" magnetic flowmeter having a flow range of 0–10 gallons per minute (gpm), an output of 4 to 20 milli-amps, and an accuracy down to 0.01 gpm.

A tachometer 32 or other line speed metering device is used to measure a line speed of conveyor 1'. Tachometer 32 may be of various known types capable of generating a signal indicative of line speed which can be supplied to PLC 29. As one example, the tachometer may be a Motortack Reliance (a division of Rockwell Intl.) tachometer with a 100 volt per 1,000 rpm output, converted to a 4 to 20 milli-amp output, providing measurement accuracy down to a single rpm.

A temperature sensor 33 is mounted adjacent conveyor 1' in a manner allowing it to take continuous temperature readings along the top surfaces of the veneer layers to be coated. Temperature sensor 33 may be, e.g., a Xerger infrared pyrometer operable within a temperature range of 32° to 500° F., providing a 4 to 20 milli-amp output and a measurement accuracy to within 1° F.

A mat height indicator 35 is mounted adjacent temperature sensor 33 and serves to provide an indication of the height of the surfaces to be coated above the moving surface of the conveyor, continuously during the production process. The mat height indicator may be of any known variety, such as ultrasonic types, e.g., the Echotouch sensor available from Flowline Co. (Seal Beach, Calif.). Such devices are capable of detecting changes in height down to about 1/10".

PLC 29 may be a commonly used type such as the Allen Bradley PLC 520E. PLC 29 may be suitably programmed with a control algorithm (to be described) using standard "Ladder Logic." Preferably, a touch screen such as the PanelView 1200 is used as a combined user display and input device (representative screens shown in FIGS. 3–6 and described later). Various other types of computer based controllers and input/output devices may be utilized as are known in the art, e.g., a suitably programmed general purpose personal computer with keyboard, mouse and display, or a dedicated device with suitable hard-wired circuit components or application specific integrated circuits (ASICs).

PLC 29 polls the outputs of flowmeter 31, tachometer 32, temperature sensor 33, and mat height indicator 35 on a continuous basis, e.g., with a frequency of 2 Hz. The nozzle position control algorithm executed by PLC 29 utilizes the outputs of these sensors to control the position of a movable member 37 of actuator 27 (and hence nozzle 9') on a continuous basis, raising and lowering nozzle 9' as necessary in order to maintain a target spread rate of resin on the veneer surfaces to be coated. Actuator 27 may be of various known types including, as schematically illustrated, a pneumatic cylinder/piston arrangement providing a 24" stroke. Alternatively, actuator 27 could be a hydraulic actuator, or a ball feed-screw type. To maintain close control of the nozzle position, actuator 27 should feed-back a signal to PLC 29 to confirm the position of movable member 37. During set-up, prior to a production run, measurements of the heights of the nozzle above the moving surface of the conveyor are made with the actuator in its lowermost and uppermost positions. These heights are recorded in PLC 29 such that a signal indicating the position of actuator movable member 37 relative to its fixed housing can be translated into a distance of the nozzle from the moving surface of the conveyor.

The nozzle position control algorithm is now described in detail. Advantageously, and as will be described, the algorithm allows the controller to be easily and accurately calibrated without the need to obtain accurate initial values of the process parameters. The preferred basic control algorithm is initially stated, and then its derivation is described:

$$H=[(c/S')\cdot(F/L)]+M \qquad \text{(Equation 1)}$$

In Equation 1, H is the height of the nozzle above the moving surface of conveyor 1'. In the preferred embodiment, this is the sole controlled variable of the inventive system. Nozzle height H is determined as a function of flow rate F, conveyor line speed L, target spread rate S' and veneer mat height M. Equation 1 derives from the inventor's recognition, after considerable analysis and unsuccessful attempts with other more complex control algorithms, that the spread rate achieved is inversely proportional to the distance D between the nozzle (outlet) and the surface to be coated (D=H−M). The inventor further recognized that the achieved spread rate is inversely proportional to the conveyor line speed L, and directly proportional to the resin flow rate F. This can be stated mathematically as:

$$S'=c(F/(D\cdot L)) \qquad \text{(Equation 2)}$$

Substituting (H−M) for D in Equation 2, then rearranging to solve for H, yields the basic control algorithm of Equation 1.

In Equations 1 and 2 above, c is a constant that can easily be determined in an initial calibration step. Contrary to considerably more complex (yet no more accurate) algorithms that would attempt to take into account the varying area of the region representing the intersection of the spray pattern and surface to be coated, the varying amount of overspray, and/or the amount of time spent within the spray pattern by any particular point on the moving surface to be coated, the present inventor recognized that in the case of a spray nozzle providing a spray pattern having a generally flat triangular shape (i.e., a relatively small depth, and variation in depth, from one side of the conveyor surface to the other), the analysis could be greatly simplified without sacrificing mathematical accuracy. Variance of the spread rate in simple inverse proportion to the distance D between the surface to be coated and the nozzle is counter-intuitive. Nonetheless, this simple inverse proportional relationship is correct, as demonstrated below.

Figure 7:
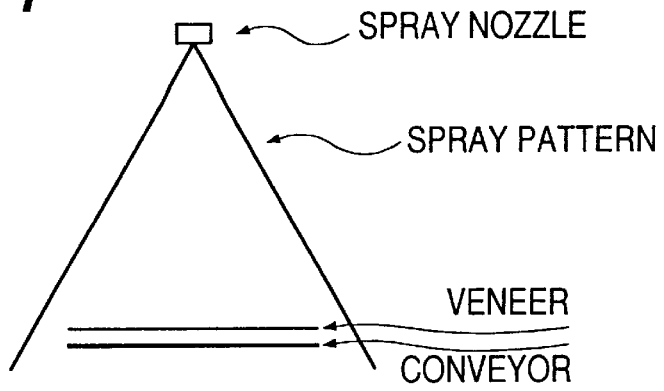
FIG. 7 is a diagrammatic sectional view taken through the spray line at one of the spray nozzles, and showing the generally triangular shape of the spray pattern in relation to the veneer conveyor.
Figure 8:
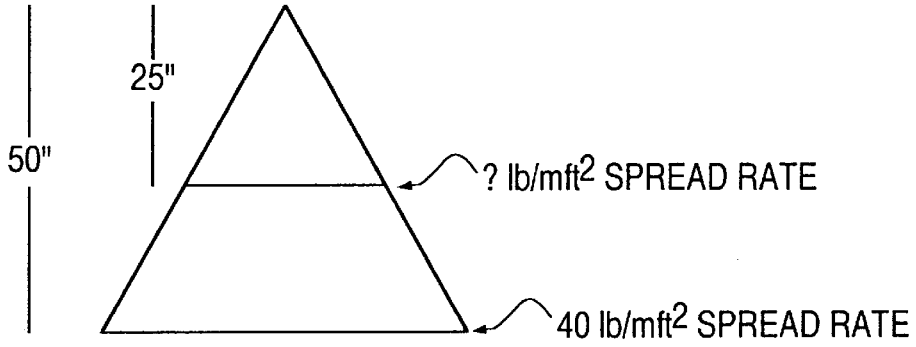
FIG. 8 is a geometric representation of the triangular spray profile shown in FIG. 9 used in derivation of a control algorithm in accordance with the present invention.

Referring to FIG. 7, looking down the length of the spray line, triangular-shaped pattern 10' of the spray as it is applied to veneer 5' is visible, as is the moving conveyor surface that veneer 5' rides on. A geometric simplification of FIG. 7 is a triangle with two ascending sides representing the outer edges of the spray pattern, and the bottom side representing the surface of veneer 5' to be coated. Due to the generally flat shape of the spray pattern, there will be negligible variation in the depth of the spray pattern (measured in the moving direction of the conveyor) across the width of the conveyor surface, and as the nozzle moves up and down within the range of operation. As such, the analysis can be simplified to one in two dimensions instead of three.

Figure 9:
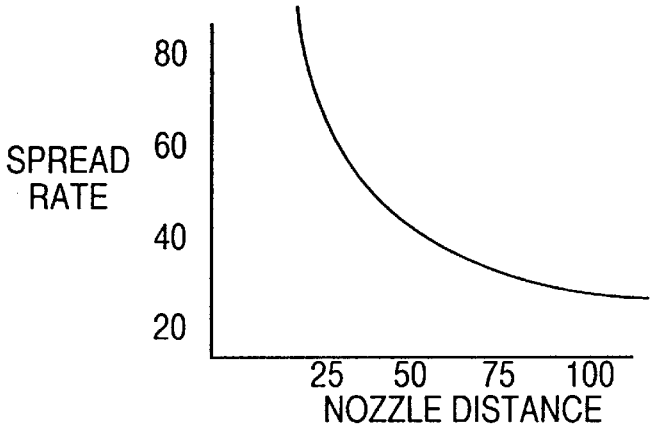
FIG. 9 is a graph plotting spread rate as a function of nozzle height, based upon the triangular shape of the spray pattern illustrated in FIG. 9, and an initial arbitrarily chosen spread rate value.

Based upon the foregoing simplification, it can readily be surmised that if the spread rates at one distance D, e.g., 50", is known, say 40 lb/mft$^2$, then the spread rate at any other distance D may be determined by simple geometry (all other variables remaining constant). This is so because, assuming a constant resin flow rate, the density of the airborne resin at the point of application to the surface to be coated will vary inversely with the width of the spray pattern, i.e., the base of the triangle defined by the plane in which the surface to be coated resides. So, for example, at a distance of D=25" (half the original distance D=50") the spread rate applied to the surface to be coated will be twice as much, i.e., 50 lb/mft$^2$. This inverse proportional relationship is illustrated in FIG. 9. Because the spread rate achieved follows directly from the density of the airborne spray at any given distance D, it is unnecessary to consider such factors as the change in the amount of overspray that occurs when the nozzle is moved from one height to another.

In practice, the particular spread rates achieved for a given distance D, flow rate F, and line speed L initially will not be known, but can be determined empirically in a straightforward calibration step. Once an actual spread rate is determined for a particular set of values H, F and L, the appropriate value of constant c in Equation 2 can be determined, based upon the difference between the actual spread rate and the spread rate calculated from Equation 2, and an initial arbitrarily chosen value of c.

Conceptually, and in development of the inventive algorithm, the inventor found it useful to consider constant c as the product $[S_1 \cdot (1/F_1) \cdot L_1 \cdot D_1]$, wherein the variables represent, respectively, arbitrarily chosen initial values of spread rate, flow rate, conveyor line speed and distance of the nozzle from the surface to be coated (i.e., $H_1 - M_1$). Such individual values may be input or coded into PLC 29, which computes the product to serve as c, in lieu of inputting or hard coding c in the form of a single value.

Figure 10:
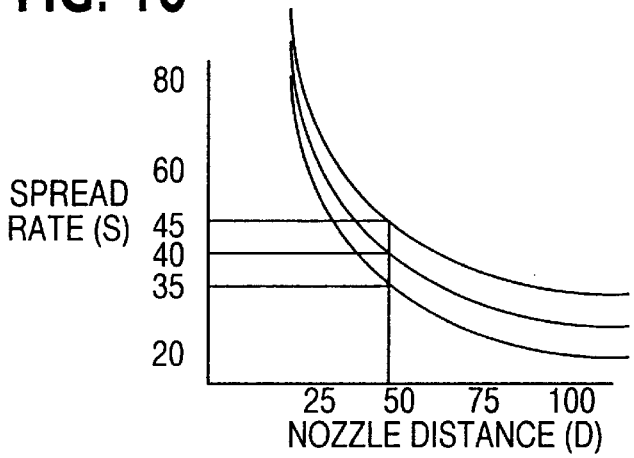
FIG. 10 is a graph like FIG. 9 showing hypothetical examples of adjustments of the curve position that may result from substituting a measured actual spread rate for the original arbitrarily chosen spread rate.
Figure 11:
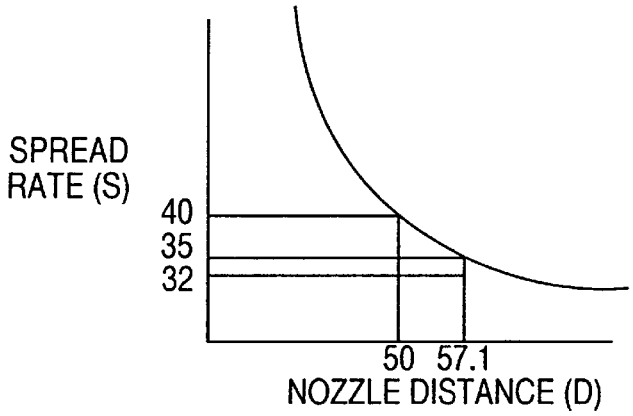
FIGS. 11 and 12 are, respectively, graphs showing particular values on the curve of FIG. 9, before and after substitution of the actual spread rate for the initial arbitrarily chosen spread rate.
Figure 12:
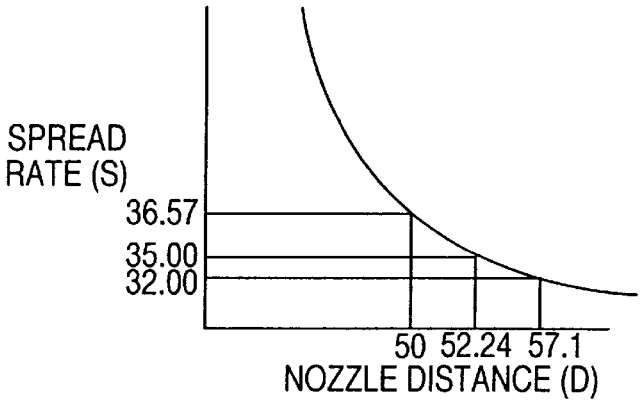

Graphically, varying constant c results in a shifting of the curve shown in FIG. 9, upwardly or downwardly as shown in FIG. 10. In the hypothetical example illustrated, it is seen (in FIG. 11) that based on the assumption of a 40 lb/mft$^2$ spread rates at a nozzle distance D of 50", a spread rate of 35 lb/mft$^2$ would be obtained by adjusting the nozzle distance to 57.1". However, as shown, an empirical check of the actual spread rate obtained at a nozzle distance of 57.1" shows the actual spread rate to be 32.0 lb/mft$^2$. Graphically then, the curve of FIG. 9 needs to be adjusted downwardly to the position shown in FIG. 12, such that the x-y coordinates (57.1, 32.0) lie on the curve.

The aforementioned calibration of the inventive apparatus is easily carried out at start-up of each spray booth. Initially, each controller is operated on the basis of an arbitrarily chosen value of c, which may be hard-coded into the controller memory (as one value or the product of several values), in order to position the actuator somewhere within its range of movement based upon anticipated values received from flowmeter 31, tachometer 32, mat height indicator 35 and temperature sensor 33, as well as a preset arbitrary target spread rate S'. Upon such start-up, the nozzle will move to an arbitrary distance (height in the preferred embodiment) H above the moving surface of the conveyor. Once resin is supplied under pressure to the nozzle, a spray pattern 10' will result. At this time, a conventional technique of directly measuring the actual spread rate is carried out, such as by placing a standard-sized thin test strip of material on a layer of veneer carried by the conveyor and passing it through the spray pattern. As in the conventional method, the amount of resin on the test strip (by weight) is determined as the difference in the weight of the test strip before and after the spray pass. The spread rate is then determined from the resin weight, and a chart providing a conversion of the weight to a per unit density, taking into account the area of the test strip. The calibration (i.e., setting of c) is then a simple matter of adjusting the original arbitrarily set value of c up or down by the percentage of error. This can be stated mathematically as:

$$c_{corr.} = ((S' + \text{error})/S') \cdot C_{arbit.} \qquad \text{(Equation 3)}$$

The corrected value of c obtained from Equation 3 can then be substituted into basic control Equation 1. As such, PLC 29 will be calibrated to accurately maintain a target spread rate, despite variations in the resin flow rate, conveyor line speed and veneer mat height. Appropriate delays in system responsiveness should be introduced by standard programming techniques to account for the offset positions of mat height indicator 35, and temperature sensor 33, from the position of the spray nozzle in the moving direction of the conveyor.

In the preferred embodiment, the target spread rate S' is not merely a value chosen by the operator for a particular production run. Rather, preferably provision is made to automatically adjust the target spread rate to compensate for veneer temperature induced fluctuations in the tackiness of the resin at the time that a load of the panel assemblies is hot-pressed. An approach found to work well in this regard is to make a one-pound adjustment to the desired spread rate for every 10° F. change in veneer temperature, from a base temperature of 90° F. As the temperature falls below 90°, the target spread rate will be decreased, and as the temperature rises above 90°, the target spread rate will be increased. This can be represented mathematically as follows:

$$S' = (S + ((T - 90)/10)) \qquad \text{(Equation 4)}$$

In the above equation, S is an initial uncompensated target spread rate, and T is the temperature sensed by temperature sensor 33 in ° F. Substituting the above for S' in Equation 1 provides the preferred final control equation, including temperature compensation, as follows:

$$H = c \cdot [1/(S + ((T - 90)/10)) \cdot (F/L)] + M \qquad \text{(Equation 5)}$$

Figure 3:
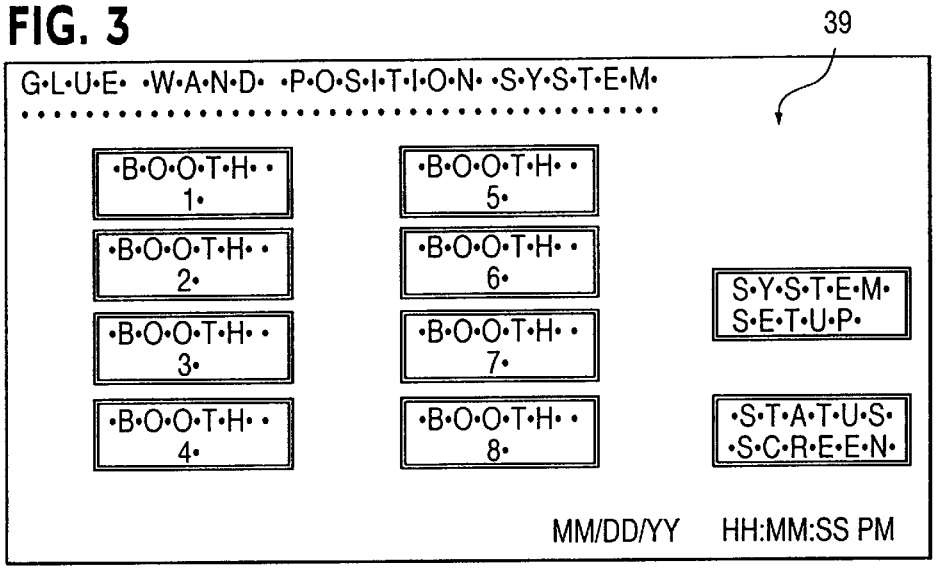
FIG. 3 depicts a main menu screen of a user interface of the programmable logic controller (plc) included in the inventive system of FIG. 2, for a spray line including eight spray booths.

Reference is now made to FIGS. 3–6 showing representative displays of the touch screen associated with PLC 29. FIG. 3 depicts a Main Menu screen 39, wherein a System Set-Up screen 41 (FIG. 5) or System Status screen 43 (FIG. 6) for any one of spray booths 1–8 (eight booth spray line) may be accessed.

Figure 4:
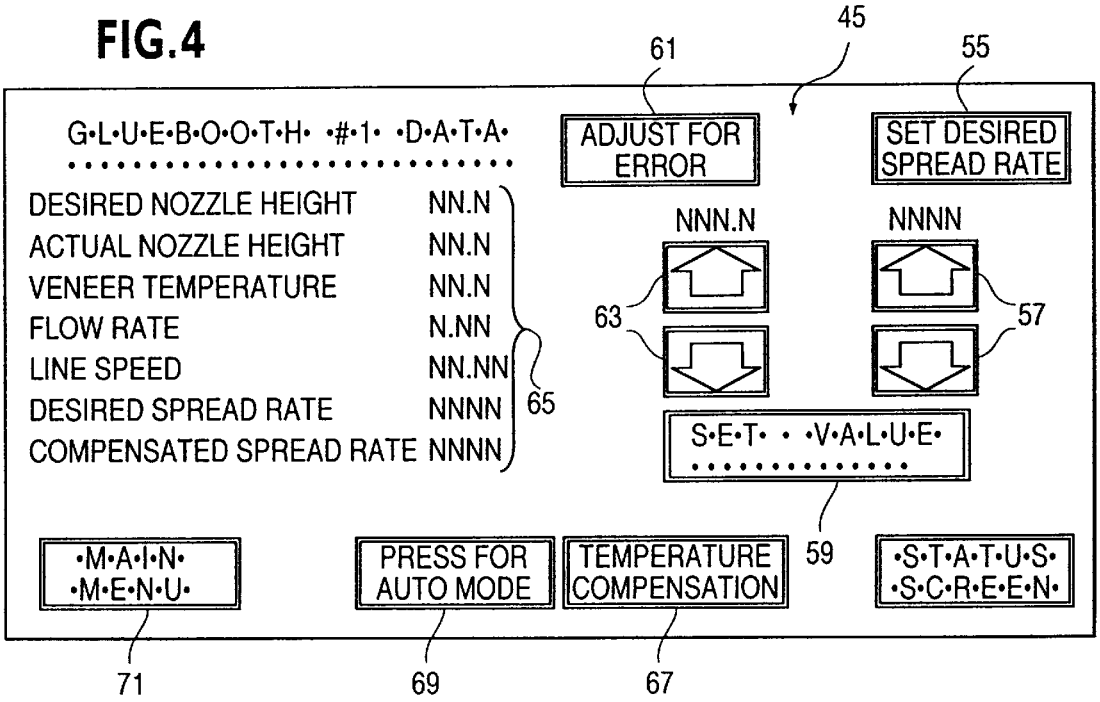
FIG. 4 depicts a representative data entry and monitoring screen for one of the eight spray booths represented in FIG. 3.
Figure 5:
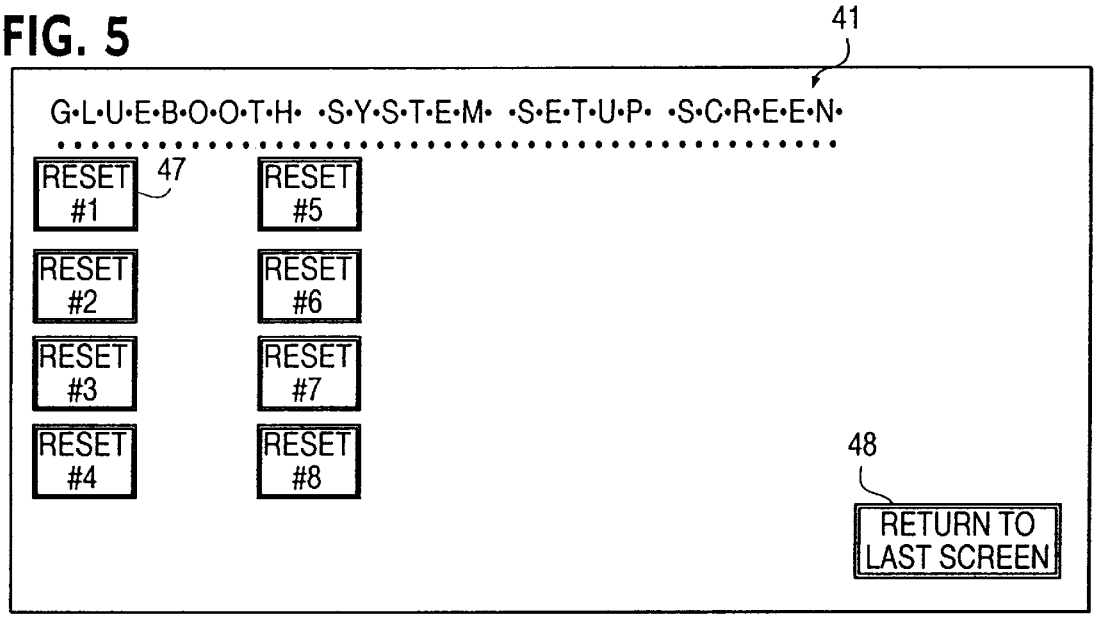
FIG. 5 depicts a system setup screen used to access a data entry and monitoring screen of the type shown in FIG. 4, for a chosen one of the eight spray booths represented in FIG. 3.

Referring to FIG. 5, System Set-Up screen 41 allows a reset of any one of the spray booth controllers. Such reset may be performed prior to use of a Data Entry and Monitoring screen 45 (FIG. 4). By pressing any one of the eight reset buttons 47, constant c in the control algorithm for the corresponding booth is returned to an initial arbitrary value hard coded or otherwise stored in the controller. An additional button 48 is provided to return to the previously displayed screen.

Figure 6:
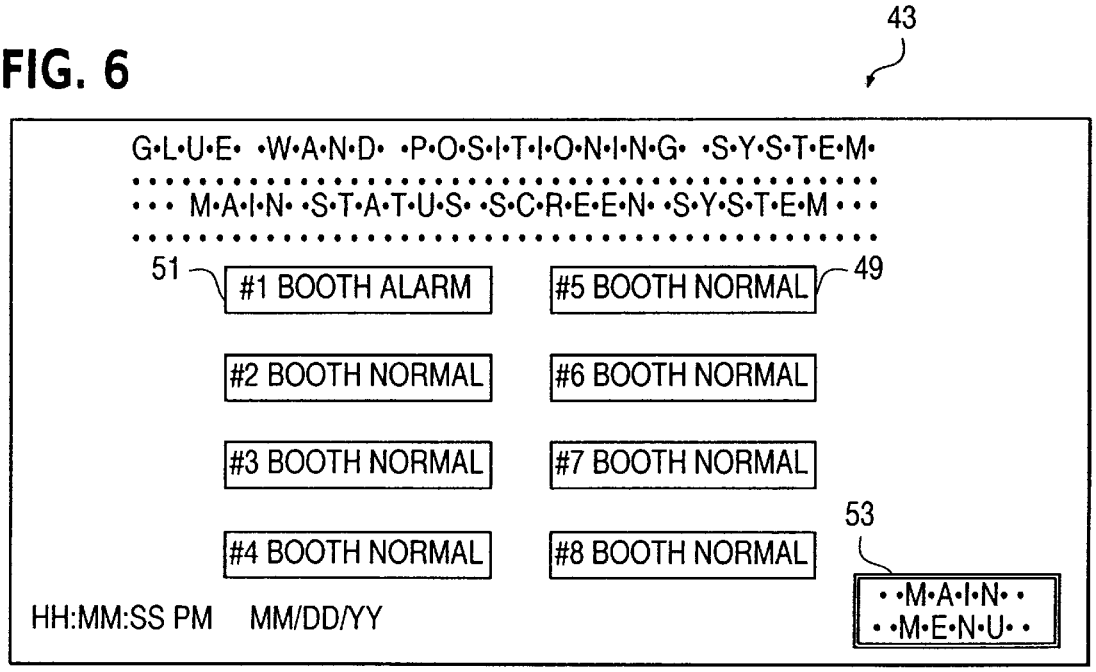
FIG. 6 depicts a status screen showing an operation status of the eight spray booths represented in FIG. 3.

Referring to FIG. 6, System Status screen 43 provides, at a glance, an indication of "normal" 49 and "alarm" 51 operating conditions of each of the eight spray booths. An alarm condition will be indicated based upon various abnormal operation conditions such as computation of a target nozzle position out of the range of actuator 27, detection of flow rate F outside of a normal range, and failure of one or more of sensors 31, 32, 33, 35. An additional button 53 is provided to return to the Main Menu.

FIG. 4 shows a representative Data Entry and Monitoring screen 45 (for spray booth 1). To prepare any one of the spray booths for operation, a reset as previously described in connection with FIG. 5 is performed. Then, the automatic operation mode is entered by pressing the PRESS FOR AUTO MODE button 69 in screen 45. Next, a desired spread rate is set. To do this, the SET DESIRED SPREAD RATE button 55 is pressed and the up-down arrow buttons 57 are manipulated until the desired spread rate is digitally displayed. The SET VALUE button 59 is pressed to lock-in the displayed value. A calibration, as previously described, is performed next, e.g., by passing a standard test strip through the spray pattern and comparing the actual spread rate with the set desired spread rate. The difference between these two values is entered into the controller by pressing the ADJUST FOR ERROR button 61 and thereafter manipulating the up-down arrow buttons 63 until the error amount is digitally displayed. Finally, SET VALUE button 59 is again pressed, this time to lock-in the set error amount. Based upon this input, the controller makes an appropriate adjustment to the constant c used in the control algorithm. Once this procedure is followed for each booth, a production spray operation can begin.

In addition to allowing data entry, Data Entry and Monitoring screen 45 provides a real-time display 65 of the computed desired nozzle height H, an actual nozzle height H' determined based upon the feedback signal from actuator 27, the veneer temperature T sensed by temperature sensor 33, the resin flow rate F sensed by flowmeter 31, the line speed L indicated by tachometer 32, the desired spread rate S set by the operator, and a compensated spread rate S' reflecting an adjustment for veneer temperature fluctuations based on Equation 4. The temperature compensation of the spread rate is provided as an optional feature enabled and disabled by a TEMPERATURE COMPENSATION button 67. Additional buttons 71, 73 are provided for returning to the Main Menu 39 illustrated in FIG. 3, and the System Status screen 43 illustrated in FIG. 6.

The most typical resin used in making southern pine plywood is a phenolic based resin. The major components of this resin are phenol and formaldehyde. There are several other components that add various viscosity, cure rate, and filling characteristics to the mix. This combination, along with other chemicals, produces a thermal setting resin which cures with the addition of heat. The percent total resin solids in the final mix typically will average from 28 to 32 percent.

The characteristics and combinations of components can be altered to cover a wide range of variables in the manufacturing process, including veneer moisture, assemble time, and ambient temperature. A resin can be formulated to run a lower or a higher desired spread rate. There is, however, a minimum amount of resin which must be applied regardless of the formulation. This minimum spread rate is a function of the lowest amount of resin solids that is required to adhere veneers together and meet certain performance requirements. Many in the industry believe this minimum spread rate to be around 30 lb/mft$^2$.

Figure 13:
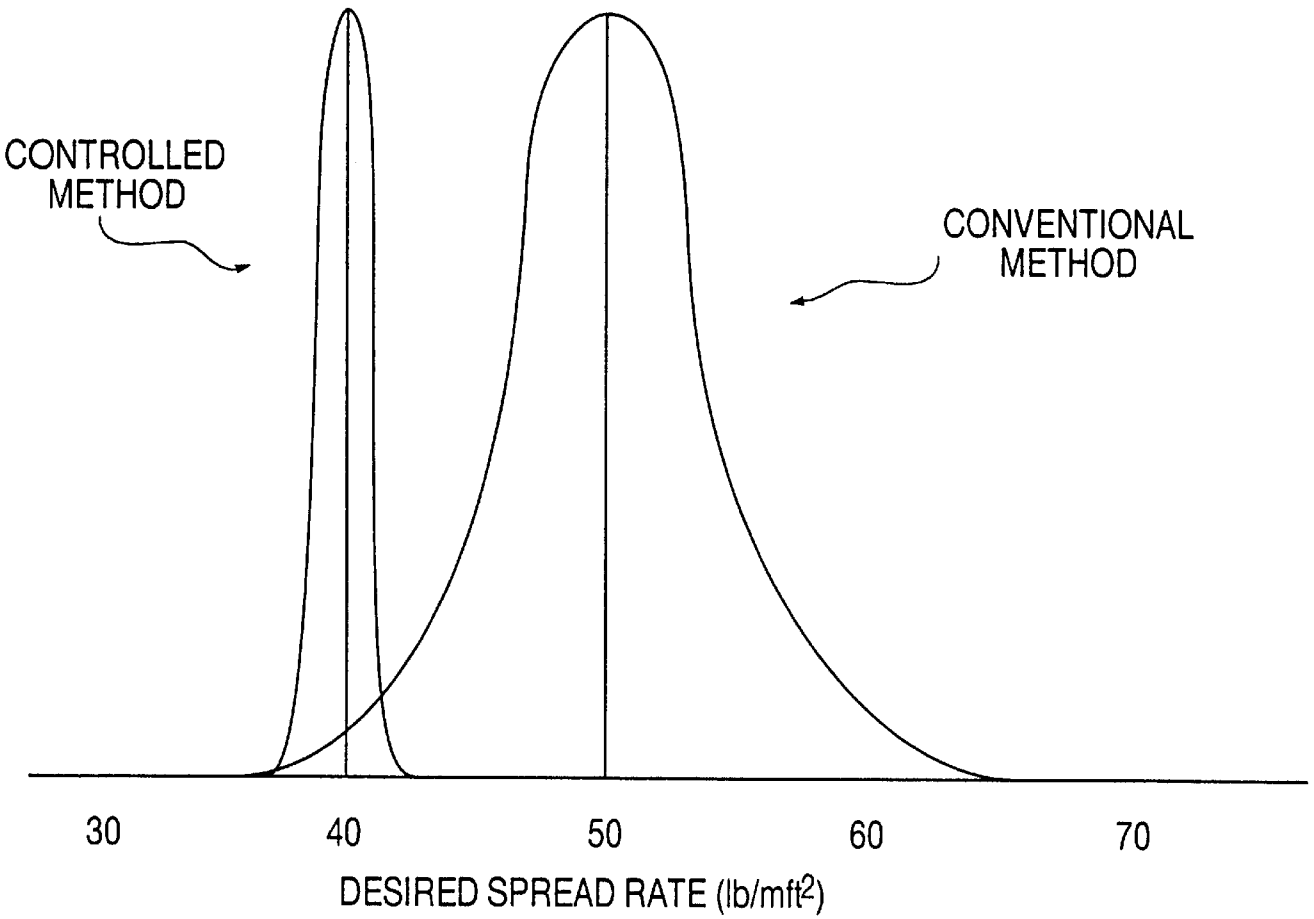
FIG. 13 is a graph providing a general illustration of the tighter control of the target spread rate obtainable with the present invention, as compared to that obtainable with the conventional spray application system/method.

Generally, a resin which is formulated to run higher spread rates has a greater degree of tolerance to changing variables, including veneer moisture, spread rate variation, assembly time, etc. A resin formulated to run lower spread rates will require more control of these variables, especially spread rate variation. As hypothetically illustrated in FIG. 13, the spread rate variation using the conventional uncontrolled spray application apparatus/method of FIG. 1 can be significant. The resin used is formulated to handle these conditions, and the average spread rate will be relatively high. In the controlled spray application method of the present invention, the spread rate variation is reduced significantly, thus allowing the use of a resin formulation that will allow lower spread rates, without going below the minimum spread rate which is required. Savings in resin consumption experienced with the inventive control method have been in the 18% to 20% range.

The present invention has been described in terms of preferred and exemplary embodiments thereof numerous other embodiments, modifications and variations within the scope and spirit of the appended claims will occur to persons of ordinary skill in the art from a review of this disclosure.

What is claimed is:

1. A spray coating apparatus providing automatic spread rate control, comprising:

a spray nozzle that produces a diverging spray pattern having a generally flat triangular shape, and a supply line connected to said spray nozzle for supplying a liquid coating material under pressure thereto;

a conveyor including a moving surface arranged to carry articles past said spray nozzle and through said diverging spray pattern such that a coating of said liquid coating material is applied to a surface of said articles;

an actuator having a movable member connected to said spray nozzle for moving the spray nozzle toward and away from the moving surface of the conveyor; and control means for (1) computing a target position of said movable member as a function in which a distance D of the nozzle, that produces a diverging spray pattern having a generally flat triangular shape, to the surface of the article to be coated varies in inverse proportional relationship to a target spread rate S', and (2) controlling the actuator to move the movable member to the computed target position, in order to maintain target spread rate S' on said surface.

2. A spray coating apparatus according to claim 1, further including a flow meter in said supply line for measuring a flow rate F of said liquid coating material and generating a signal indicative thereof which is supplied to said control means, said function further varying distance D in direct proportion to flow rate F.

3. A spray coating apparatus according to claim 2, further including a conveyor line speed meter for measuring a line speed of said conveyor and generating a signal indicative thereof which is supplied to said control means, said function further varying distance D in inverse proportion to line speed L.

4. A spray coating apparatus according to claim 3, further including a temperature sensor for taking temperature readings T along said surface to be coated and outputting to said control means a signal indicative thereof, and wherein S' is a temperature compensated target spread rate computed as a function of said temperature readings T.

5. A spray coating apparatus according to claim 4, wherein S' is computed as:

$$S'=S+((T-90)/10)$$

wherein, S is a preset non-temperature compensated target spread rate and T is a temperature in ° F. detected by said temperature sensor.

6. A spray coating apparatus according to claim 1, further including a conveyor line speed meter for measuring a line speed L of the conveyor and generating a signal indicative thereof which is supplied to said control means, said function further varying distance D in inverse proportion to line speed L.

7. A spray coating apparatus according to claim 6, further including a temperature sensor for taking temperature readings T along said surface to be coated and outputting to said control means a signal indicative thereof, and wherein S' is a temperature compensated target spread rate computed as a function of said temperature readings T.

8. A spray coating apparatus according to claim 7, wherein S' is computed as:

$$S'=S+((T-90)/10)$$

wherein, S is a preset non-temperature compensated target spread rate, and T is a temperature in ° F. detected by said temperature sensor.

9. A spray coating apparatus according to claim 1, further including a mat height indicator for indicating a distance M of the surface to be coated from the moving surface of the conveyor, and outputting to said control means a signal indicative thereof, wherein said control means computes a distance H of the nozzle from the moving surface based on the relationship:

$$H=D+M.$$

10. A spray coating apparatus according to claim 3, further including a mat height indicator for indicating a distance M of the surface to be coated from the moving surface of the conveyor, and outputting to said control means a signal indicative thereof, wherein said control means computes a distance H of the nozzle from the moving surface based on the relationship:

$$H=D+M.$$

11. A spray coating apparatus according to claim 8, further including a mat height indicator for indicating a distance M of the surface to be coated from the moving surface of the conveyor, and outputting to said control means a signal indicative thereof, wherein said control means computes a distance H of the nozzle from the moving surface based on the relationship:

$$H=D+M.$$

12. A spray coating apparatus according to claim 9, wherein said actuator outputs a signal to said control means indicative of an actual position of the movable member, from which said control means computes an actual distance H' of the nozzle from the moving surface of the conveyor, and said control means comprises display means for displaying said actual distance H', as well as the computed target distance H.

13. A spray coating apparatus according to claim 11, said control means further comprising input means for inputting values of S', and display means for displaying values of at least one of F, L, M and T detected by said flowmeter, line speed meter, mat height indicator and temperature sensor, respectively.

14. A method of calibrating the spray coating apparatus according to claim 1, comprising:

causing said control means to position said spray nozzle, with said actuator, in accordance with said function, including an initial arbitrarily assigned value of c and an arbitrarily chosen value of S', and supplying a liquid coating material under pressure to said nozzle;

conveying a test piece of material through said spray pattern on the conveyor;

determining from said test strip an actual spread rate S" obtained;

calculating an error value E as the difference between the actual spread rate S" and the target spread rate S';

calculating a corrected initial value of c according to the formula:

$$c_{corr.}=((S'+E)/S')\cdot c;\text{ and}$$

substituting $c_{corr.}$ for c in said function.

15. A method of controlling a spray coating apparatus including a spray nozzle that produces a diverging spray pattern having a generally flat triangular shape, a supply line connected to said spray nozzle for supplying a liquid coating material under pressure thereto, a conveyor including a moving surface arranged to carry articles past said spray nozzle and through said diverging spray pattern such that a coating of said liquid coating material is applied to a surface thereof, and an actuator having a movable member connected to said spray nozzle for moving the spray nozzle toward and away from the moving surface of the conveyor, said method comprising:

computing a target position of said movable member as a function in which a distance D of the nozzle, that produces a diverging spray pattern having a generally flat triangular shape, from the surface of the article to be coated varies in inverse proportional relationship to a target spread rate S'; and controlling the actuator to move the movable member to the computed target position in order to maintain target spread rate S' on said surface.

16. A method according to claim 15, further including measuring a flow rate F of said liquid coating material and generating a signal indicative thereof, and computing a target position of said movable member as a function in which distance D is further varied in direct proportion to flow rate F.

17. A method according to claim 16, further including measuring a line speed L of said conveyor and computing a target position of said movable member as a function in which distance D is further varied in inverse proportion to line speed L.

18. A method according to claim 17, further including taking temperature readings T, along said surface to be coated and computing S' as a function of said temperature readings T to compensate for temperature fluctuations.

19. A method according to claim 18, wherein S' is computed as:

$$S'=S+((T-90)/10)$$

wherein, S is a preset non-temperature compensated target spread rate and T is a detected temperature in ° F.

20. A method according to claim 15, further including measuring a line speed L of said conveyor and computing a target position of said movable member as a function in which the distance D is further varied in inverse proportion to line speed L.

21. A method according to claim 20, further including taking temperature readings T along said surface to be coated and computing S' as a function of said temperature readings T, to compensate for temperature fluctuations.

22. A method according to claim 21, wherein S' is computed as:

$$S'=S+((T-90)/10)$$

wherein, S is a preset non-temperature compensated target spread rate and T is a detected temperature in ° F.

23. A method according to claim 15, further including determining a distance M of the surface to be coated from the moving surface of the conveyor, and computing a distance H of the nozzle from the moving surface of the conveyor based on the relationship:

$$H=D+M.$$

24. A method according to claim 17, further including determining a distance M of the surface to be coated from the moving surface of the conveyor, and computing a distance H of the nozzle from the moving surface of the conveyor based on the relationship:

$$H=D+M.$$

25. A method according to claim 22, further including determining a distance M of the surface to be coated from the moving surface of the conveyor, and computing a distance H of the nozzle from the moving surface of the conveyor based on the relationship:

$$H=D+M.$$

26. A method according to claim 13, further comprising calibrating the spray coating apparatus, said calibrating including:

positioning with said actuator said spray nozzle in accordance with said function, including an initial arbitrary value of constant c and an arbitrary value of S', and supplying a liquid coating material under pressure to said nozzle;

conveying a test piece of material on the moving surface of the conveyor through said spray pattern on the conveyor;

determining from said test strip an actual spread rate S" obtained;

calculating an error value E as the difference between the actual spread rate S" and the target spread rate S';

calculating a corrected initial value of c according to the formula:

$$c_{corr.}=((S'+E)/S')\cdot c;\text{ and}$$

substituting $c_{corr.}$ for c in said function.

* * * * *